US007568358B2

(12) United States Patent
Wetekamp

(10) Patent No.: US 7,568,358 B2
(45) Date of Patent: Aug. 4, 2009

(54) CONTROL FOR A REFRIGERATOR DOOR DISPENSER LIGHT

(75) Inventor: Robert L. Wetekamp, Cedar Rapids, IA (US)

(73) Assignee: Maytag Corporation, Benton Harbor, MI (US)

( * ) Notice: Subject to any disclaimer, the term of this patent is extended or adjusted under 35 U.S.C. 154(b) by 440 days.

(21) Appl. No.: 11/327,412

(22) Filed: Jan. 9, 2006

(65) Prior Publication Data

US 2007/0157638 A1 Jul. 12, 2007

(51) Int. Cl.

| | |
|---|---|
| ***F25B 49/00*** | (2006.01) |
| ***F21V 33/00*** | (2006.01) |
| ***F25D 27/00*** | (2006.01) |
| ***F27D 21/02*** | (2006.01) |

(52) U.S. Cl. ..... 62/126; 62/125; 62/129; 222/52; 222/146.6; 362/92

(58) Field of Classification Search ..... 62/66, 62/89, 187, 125, 126, 129, 131, 161–164, 62/207; 704/270; 222/52, 146.6; 362/92, 362/93, 94

See application file for complete search history.

(56) References Cited

U.S. PATENT DOCUMENTS

| | | | | |
|---|---|---|---|---|
| 4,754,376 | A * | 6/1988 | Winslow | 362/92 |
| 4,851,662 | A | 7/1989 | Ott et al. | |
| 5,033,273 | A * | 7/1991 | Buchser et al. | 222/146.6 |
| 5,552,676 | A * | 9/1996 | Viljanen | 315/151 |
| 5,581,158 | A | 12/1996 | Quazi | |
| 5,910,653 | A | 6/1999 | Campo | |
| 6,114,813 | A | 9/2000 | Lo et al. | |
| 6,495,973 | B1 | 12/2002 | Allen, Jr. | |
| 6,802,186 | B2 * | 10/2004 | Holmes et al. | 62/187 |
| 6,804,974 | B1 * | 10/2004 | Voglewede et al. | 62/264 |
| 6,951,402 | B1 * | 10/2005 | Copp | 362/94 |
| 7,201,005 | B2 * | 4/2007 | Voglewede et al. | 62/126 |
| 7,210,808 | B2 * | 5/2007 | Malpetti | 362/92 |

(Continued)

FOREIGN PATENT DOCUMENTS

KR 1996-037508 * 8/1996

OTHER PUBLICATIONS

Choi, Byeong-Jun; The cold feed appatatus and cotrol method pf refrigeration; Aug. 31, 1996; Korean Intellectual Website; Daewoo Electronics Co. Ltd.*

*Primary Examiner*—Ljiljana (Lil) V Ciric
(74) *Attorney, Agent, or Firm*—Kirk W. Goddwin; Diederiks & Whitelaw, PLC

(57) ABSTRACT

A door mounted dispenser for a refrigerator includes rear and opposing side walls that collectively define a cavity, a release mechanism for dispensing ice and/or water and a light for illuminating the cavity. The cavity light can be operated in one of three distinct modes, i.e., in a first mode wherein the cavity light is continuously illuminated, in a second mode wherein the cavity light is illuminated only through activation of the release mechanism, and in a third mode wherein the cavity light is illuminated based upon a sensed level of ambient light present at or near the refrigerator. In the third mode, the cavity light is illuminated at a first level based upon ambient light and a second, higher level when the release mechanism is operated. The level of ambient light necessary to activate the cavity light can be set by a consumer through control panel inputs.

12 Claims, 2 Drawing Sheets

U.S. PATENT DOCUMENTS

| | | | | |
|---|---|---|---|---|
| 7,493,774 | B2 * | 2/2009 | Ferragut et al. | 222/52 |
| 2004/0163397 | A1 * | 8/2004 | Ferragut et al. | 62/129 |
| 2007/0044497 | A1 * | 3/2007 | Roo et al. | 62/126 |
| 2007/0157637 | A1 * | 7/2007 | Ferragut et al. | 62/126 |
| 2007/0157640 | A1 * | 7/2007 | Bolger et al. | 62/129 |
| 2007/0157641 | A1 * | 7/2007 | Ferragut et al. | 222/146.6 |
| 2007/0157642 | A1 * | 7/2007 | Ferragut et al. | 62/139 |
| 2007/0157645 | A1 * | 7/2007 | Anell et al. | 62/187 |

* cited by examiner

CONTROL FOR A REFRIGERATOR DOOR DISPENSER LIGHT

BACKGROUND OF THE INVENTION

1. Field of the Invention

The present invention pertains to the art of refrigerators and, more particularly, to a control for operating a light associated with a refrigerator door dispenser.

2. Discussion of the Prior Art

Door mounted dispensers are widely known in the art of refrigerators. Typically, the dispenser is mounted in the freezer door and, when activated, dispenses ice and/or water depending upon a consumer's particular need. Dispensers are provided in various forms and with a variety of features depending on the particular refrigerator model. That is, dispensers can range from models that simply dispense ice cubes and/or water, to more complex models that dispense ice in various forms, as well as provide filtered water.

Most dispensers incorporate a light that is illuminated whenever the dispenser is activated. In some cases, the dispenser light can be employed as a night light. That is, the light is illuminated at a first level based upon ambient light conditions and, at a second, higher, level when the dispenser is activated. The higher level increases visibility in order to enable a consumer to readily release ice or water into, for example, a glass. However, one problem encountered with the night light is establishing an ambient light level at which the light will be illuminated at the first level. It has been found that, depending on the installation, the light is typically illuminated too early in the day. In some particularly low-light level installations, the light may be operated continuously, thereby providing a false impression that a problem may exist with the refrigerator. In either case, the overall service life of the light is reduced significantly.

Therefore, despite the existence of light controls for dispensers in the prior art, there still exists a need for a control for a refrigerator dispenser light. More specifically, there exists a need for a control that enables a consumer to selectively set an ambient light level at which the dispenser light is activated when operating in a night light mode.

SUMMARY OF THE INVENTION

The present invention is directed to a light control for a dispenser mounted on a refrigerator door. The refrigerator includes an outer shell within which is defined a fresh food compartment and a freezer compartment. The refrigerator further includes a door which is pivotally mounted relative to the outer shell for selectively closing at least one of the fresh food and freezer compartments. The door is provided with a dispenser that enables a consumer to retrieve ice and/or water without accessing the compartment, while the dispenser incorporates a light.

In accordance with a preferred embodiment of the invention, the dispenser includes rear and opposing side walls that collectively define a cavity, which is adapted to be illuminated by the light, and a release mechanism for dispensing ice and/or water. The light can be operated in one of three distinct modes. In a first mode, the light is continuously illuminated. In a second mode, the light is illuminated only through activation of the release mechanism. In a third mode, the light is illuminated based upon a sensed level of ambient light present at or near the refrigerator. More specifically, in the third mode, the light is illuminated at a first level based upon ambient light, and a second, higher level when the release mechanism is operated. In the most preferred form of the invention, the level of ambient light required to activate the light in the third mode can be set by a consumer through control panel inputs.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENTS

Figure 1:
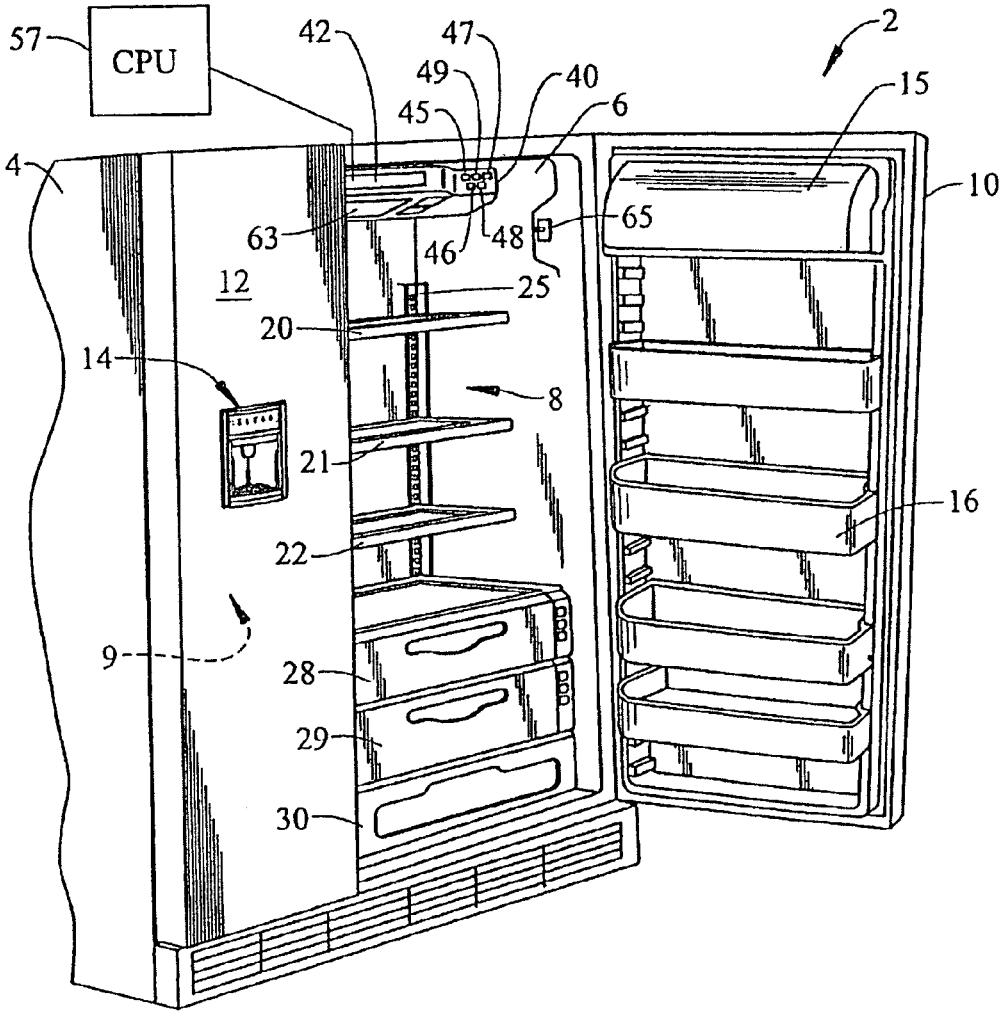
FIG. 1 is a partial, right perspective view of a refrigerator including a control for selectively activating a light associated with a door mounted dispenser constructed in accordance with the present invention.

With initial reference to FIG. 1, a refrigerator 2 includes an outer shell or cabinet 4 within which is positioned a liner 6 that defines a fresh food compartment 8. Another liner (not shown) is also positioned in cabinet 4 to define a freezer compartment 9. In a manner known in the art, fresh food compartment 8 can be accessed by the selective opening of a fresh food door 10. In a similar manner, a freezer door 12 can be opened to access freezer compartment 9. In the embodiment shown, freezer door 12 includes a dispenser 14 that enables a consumer to retrieve ice and/or fresh water without accessing fresh food compartment 8 or freezer compartment 9. For the sake of completeness, fresh food door 10 is shown to include a dairy compartment 15 and various vertically adjustable shelving units, one of which is indicated at 16.

In a manner also known in the art, fresh food compartment 8 is provided with a plurality of vertically height adjustable shelves 20-22 supported by a pair of shelf support rails, one of which is indicated at 25. At a lowermost portion of fresh food compartment 8 is illustrated various temperature or climate controlled bins 28 and 29, as well as a conventional storage compartment 30. At an upper region of fresh food compartment 8 is mounted a temperature control housing or user interface 40. In the embodiment shown, interface 40 includes a display zone 42 and a plurality of control elements 45-49. Control elements 45-48 are constituted by temperature control elements for adjusting a temperature of fresh food compartment 8 and freezer compartment 9, while control element 49 is constituted by an auxiliary control element for re-setting, for example, a door alarm. The particular details of user interface 40 are set forth in greater detail in commonly assigned U.S. patent application entitled "Refrigerator Control Including a Hidden Features Menu" filed on even date herewith. In any event, for the sake of completeness, interface 40 includes a controller or CPU 57 operatively connected to refrigeration components (not shown), as well as a light 63 which, in a manner known in the art, is controlled by a switch 65 operated by opening and closing door 10.

Figure 2:
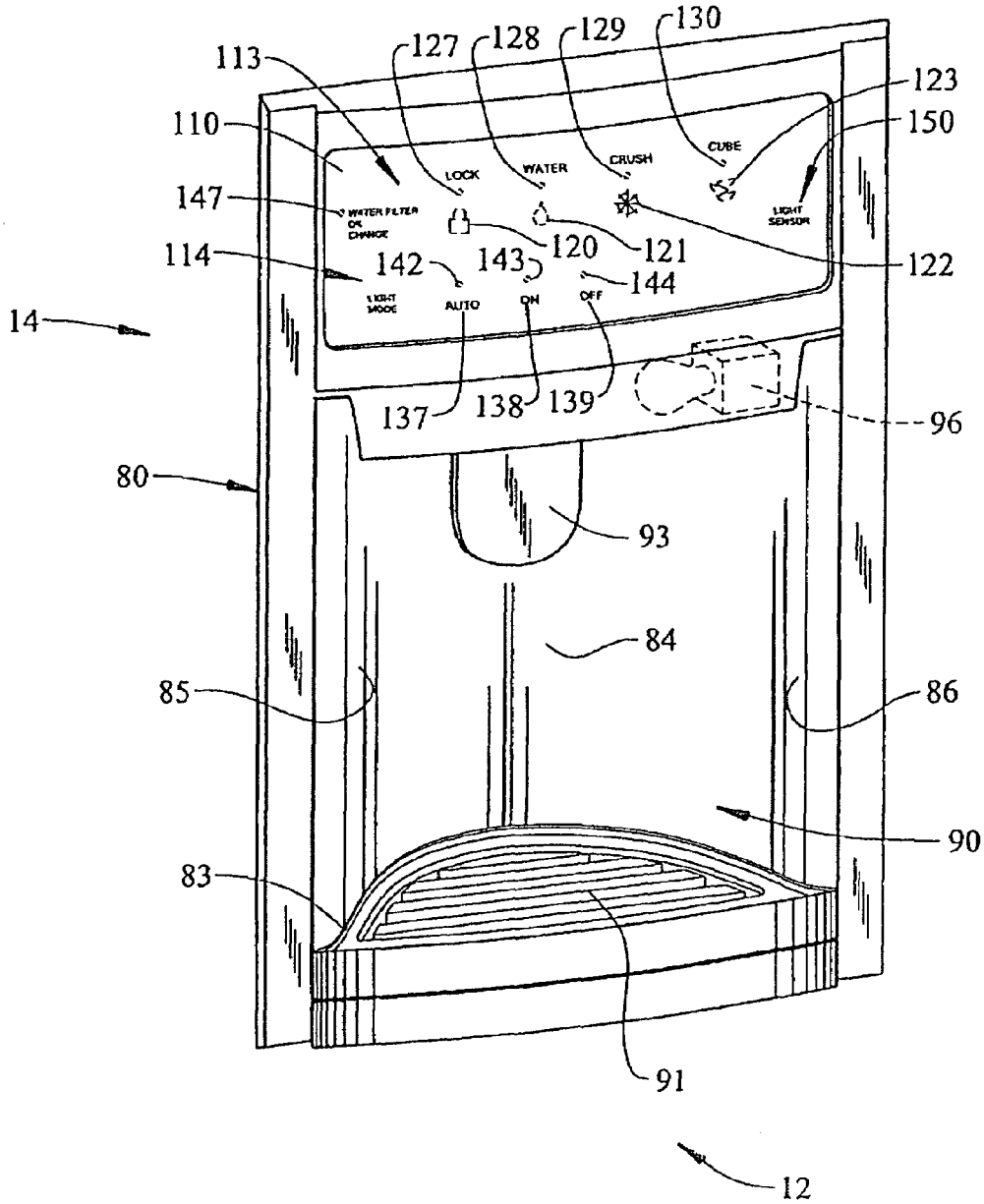
FIG. 2 is an enlarged perspective view of a portion of the door mounted dispenser of FIG. 1.

The present invention is directed to the particular operation of dispenser 14. As best shown in FIG. 2, dispenser 14 includes a housing 80 having bottom, rear and opposing side walls 83-86 that collectively define a cavity 90. As shown, bottom wall 83 is provided with a removable grate 91 that entraps water or melted ice and provides a stable surface for a container or glass. In addition, dispenser 14 is shown to include a release mechanism 93 which, when activated, delivers water and/or ice depending upon a consumer's particular need in a manner that will be described more fully below. Dispenser 14 is also provided with a cavity light 96 which is activated to illuminate cavity 90.

As further shown in FIG. 2, dispenser 14 includes a control panel 110 having a plurality of control elements. In accordance with one embodiment, the control elements are constituted by first and second sets of dispenser control buttons 113 and 114. As shown, the first set of control buttons 113 includes a lock button 120, a water button 121, a crushed ice button 122 and a cubed ice button 123. Each of buttons 120-123 is preferably provided with a corresponding indicator light 127-130 which, when illuminated, indicates which one of buttons 120-123 has been selected. In accordance with the most preferred form of the invention, the second set of control buttons 114 is employed to set an operational mode for cavity light 96. More specifically, second set of control buttons 114 includes an AUTO button 137, an ON button 138 and an OFF button 139 which establishes three distinct operating modes for cavity light 96. In a manner similar to that described above, control buttons 137-139 have associated therewith corresponding indicator lights 142-144 which, when illuminated, designate the current or active mode for cavity light 96. For the sake of completeness, control panel 110 is also shown to include a water filter indicator 147 that signals when a water filter (not shown), associated with dispenser 14, requires changing. Finally, control panel 110 is provided with a sensor 150 which, in a manner that will be discussed below, is operatively associated with cavity light 96.

As set forth above, cavity light 96 is operable in three distinct modes which may be selected through control buttons 137-139. More specifically, cavity light 96 can be operated in an AUTO mode through activation of button 137, an ON mode through activation of button 138 and an OFF mode through activation of button 139. In the ON mode, cavity light 96 is continuously illuminated as long as power is supplied to refrigerator 2, regardless of whether release mechanism 93 is activated. Conversely, in the OFF mode, cavity light 96 remains inactive until release mechanism 93 is activated to dispense water and/or ice. More specifically, manipulation of release mechanism 93 activates cavity light 96 to illuminate cavity 90. In the most preferred form of the invention, once a consumer has completed the water and/or ice dispensing operation, i.e., following de-activation of the dispensing operation, the intensity of cavity light 96 will gradually decrease or decay as if on a dimmer, until cavity light 96 is inactive.

In the AUTO mode, cavity light 96 is activated when ambient light, at or about refrigerator 2, reaches a predetermined level. More specifically, as ambient light about refrigerator 2 begins to diminish, cavity light 96 is activated to serve as, for example, a night light. In accordance with one aspect of the invention, cavity light 96 is activated at a first illumination level once the ambient light has reached the predetermined level. However, when release mechanism 93 is activated, the intensity of cavity light 96 increases to full power to provide illumination to cavity 90. In a manner similar to that described above with respect to the OFF mode of operation, once the consumer has finished dispensing water and/or ice, the intensity of cavity light 96 will gradually decrease or decay, as if on a dimmer, until reaching the first intensity level.

In accordance with the most preferred form of the invention, the predetermined level of ambient light can be selected by a consumer. That is, if a consumer wishes to have cavity light 96 activated at either a lighter or darker ambient light level, the consumer simply selects the desired light level through interface 40. In further accordance with the most preferred form of the invention, a user can select from a low light level through a high light level by choosing a value between 1 and, for example, 7. For example, if a consumer wishes cavity light 96 to be illuminated at a higher degree of ambient light, a 1 is entered into a light level selection portion of interface 40 or, alternatively, if a consumer wishes ambient light to be at a lower level, a 7 can be entered into interface 40. With this arrangement, the light control of the present invention allows a consumer to adapt an operation of a dispenser cavity light 96 to accommodate various installations. That is, depending on whether the refrigerator is located in lighter or darker areas of a kitchen, operation of the cavity light 96 can be tailored to the surrounding light levels.

Although described with reference to a preferred embodiment of the invention, it should be readily understood that various changes and/or modifications can be made to the invention without departing from the spirit thereof. For instance, the particular form and arrangement of control panel 110 and, for that matter, dispenser 14, can vary without departing from the scope of the present invention. In general, the invention is only intended to be limited by the scope of the following claims.

I claim:

1. A refrigerator comprising:

a cabinet;

a door pivotally mounted to the cabinet for exposing an interior compartment of the refrigerator;

a control panel having a plurality of control elements for inputting operating parameters for the refrigerator;

a dispenser formed in the door, said dispenser including a housing having bottom, rear and opposing side walls that collectively define a cavity, a mechanism for dispensing at least one of ice and water, and a light for selectively illuminating the cavity;

a sensor for sensing a level of ambient light; and a means for controlling the light cavity in three distinct modes wherein, in a first mode the light cavity is continuously illuminated, in a second mode the light cavity is illuminated only through activation of the dispensing mechanism and, in a third mode the light cavity is illuminated based upon whether the level of ambient light is less than a predetermined level, wherein:

a) said predetermined level is adjustable;

b) when in the third mode, the controlling means activates the light cavity at a first level based upon the level of ambient light and at a second level upon activation of the dispensing mechanism; and c) the light cavity is illuminated at gradually decreasing levels following deactivation of the dispensing mechanism.

2. A refrigerator comprising:

a cabinet;

a door pivotally mounted to the cabinet for exposing an interior compartment of the refrigerator;

a control panel having a plurality of control elements for inputting operating parameters for the refrigerator;

a dispenser formed in the door, said dispenser including a housing having bottom, rear and opposing side walls that collectively define a cavity, a mechanism for dispensing at least one of ice and water, and a light for selectively illuminating the cavity;

a sensor for sensing a level of ambient light; and a means for controlling the light cavity in three distinct modes wherein, in a first mode the light cavity is continuously illuminated, in a second mode the light cavity is illuminated only through activation of the dispensing mechanism and, in a third mode the light cavity is illuminated based upon whether the level of ambient light is less than a predetermined level, wherein said predetermined level is adjustable.

3. The refrigerator according to claim 2, wherein the predetermined level is adjustable through the control panel.

4. The refrigerator according to claim 2, wherein when in the third mode, the controlling means activates the light cavity at a first level based upon the level of ambient light and at a second level upon activation of the dispensing mechanism.

5. The refrigerator according to claim 4, wherein the dispenser further includes at least one control element for selecting between the first, second and third modes.

6. The refrigerator according to claim 4, wherein the dispenser further includes a plurality of indicator lights, said indicator lights being associated with each of the first, second and third modes.

7. The refrigerator according to claim 2, wherein the light cavity is illuminated at gradually decreasing levels following de-activation of the dispensing mechanism.

8. A refrigerator comprising:

a cabinet;

a door pivotally mounted to the cabinet for exposing an interior compartment of the refrigerator;

a control panel having a plurality of control elements for inputting operating parameters for the refrigerator;

a dispenser formed in the door, said dispenser including a housing having bottom, rear and opposing side walls that collectively define a cavity, a mechanism for dispensing at least one of ice and water, and a light for selectively illuminating the cavity;

a sensor for sensing a level of ambient light; and a means for controlling the light cavity in three distinct modes wherein, in a first mode the light cavity is continuously illuminated, in a second mode the light cavity is illuminated only through activation of the dispensing mechanism and, in a third mode the light cavity is illuminated based upon whether the level of ambient light is less than a predetermined level wherein, when in the third mode, the controlling means activates the light cavity at a first level based upon the level of ambient light and at a second level upon activation of the dispensing mechanism.

9. The refrigerator according to claim 8, wherein the predetermined level is adjustable through the control panel.

10. The refrigerator according to claim 8, wherein the dispenser further includes at least one control element for selecting between the first, second and third modes.

11. The refrigerator according to claim 10, wherein the dispenser further includes a plurality of indicator lights, said indicator lights being associated with each of the first, second and third modes.

12. The refrigerator according to claim 8, wherein the light cavity is illuminated at gradually decreasing levels following de-activation of the dispensing mechanism.

* * * * *